US008740219B1

(12) United States Patent
Rinaldis

(10) Patent No.: US 8,740,219 B1
(45) Date of Patent: Jun. 3, 2014

(54) APPARATUS, SYSTEM AND METHOD FOR AN ELECTRONIC POKER GAME VARIATION

(76) Inventor: Marcelo Rinaldis, Tulsa, OK (US)

( * ) Notice: Subject to any disclaimer, the term of this patent is extended or adjusted under 35 U.S.C. 154(b) by 0 days.

(21) Appl. No.: 13/112,399

(22) Filed: May 20, 2011

Related U.S. Application Data

(60) Provisional application No. 61/346,810, filed on May 20, 2010.

(51) Int. Cl.
*A63F 1/00* (2006.01)

(52) U.S. Cl.
USPC ..... 273/292; 463/11; 463/17

(58) Field of Classification Search
CPC .. A63F 3/00157; G07F 17/32; G07F 17/3293
USPC ..... 273/293
See application file for complete search history.

(56) References Cited

U.S. PATENT DOCUMENTS

| | | | | |
|---|---|---|---|---|
| 5,043,887 | A | 8/1991 | Richardson | |
| 6,280,325 | B1 | 8/2001 | Fisk | |
| 6,599,188 | B2 | 7/2003 | Hirsch et al. | |
| 7,717,785 | B2 | 5/2010 | Odom | |
| 2003/0222402 | A1* | 12/2003 | Olive | 273/292 |
| 2004/0033830 | A1* | 2/2004 | Gold et al. | 463/20 |
| 2004/0188938 | A1* | 9/2004 | Moody et al. | 273/292 |
| 2005/0101387 | A1 | 5/2005 | Wolf | |
| 2005/0164773 | A1 | 7/2005 | Lind et al. | |
| 2005/0208991 | A1 | 9/2005 | Luciano, Jr. et al. | |
| 2006/0035700 | A1 | 2/2006 | Van Asdale | |
| 2006/0052160 | A1 | 3/2006 | Saffari et al. | |
| 2006/0205468 | A1 | 9/2006 | Saffari et al. | |
| 2006/0211472 | A1* | 9/2006 | Walker et al. | 463/16 |
| 2006/0211483 | A1 | 9/2006 | Padgett | |
| 2008/0169606 | A1* | 7/2008 | Smith et al. | 273/292 |
| 2010/0041459 | A1 | 2/2010 | Saffari et al. | |

* cited by examiner

*Primary Examiner* — Melba Bumgarner
*Assistant Examiner* — George Howarah
(74) *Attorney, Agent, or Firm* — Frederic Dorwart, Lawyers; Penina Michlin Chiu

(57) ABSTRACT

An apparatus, system and method for an electronic poker game variation comprising generating a first electronic poker hand comprising at least one card and comparing the first electronic poker hand to a set of qualifying hands to identify a qualifying hand. A qualifying hand may comprise a hand one card short of a winning hand. At the conclusion of the game, offering a second chance to win to players with qualifying hands, the second chance comprising generating an extra card, creating a second electronic poker hand selected from the first electronic poker hand and the extra card and applying the winning hands to the second electronic poker hand to identify a second chance winner. The cost of an extra card may be the expected value of the extra card. The second electronic poker hand may be chosen by selecting the hand with the highest value.

7 Claims, 9 Drawing Sheets

1002
1003
PROCESSOR
1004
MAIN MEMORY
1006
1005
DISPLAY INTERFACE
DISPLAY UNIT
SECONDARY MEMORY
1014
1012
HARD DISK DRIVE
1015
1016
REMOVABLE STORAGE DRIVE
REMOVABLE STORAGE UNIT
1022
INTERFACE
REMOVABLE STORAGE UNIT
1020
COMMUNICATION INFRASTRUCTURE (BUS)
COMMUNICATION INTERFACE
COMMUNICATION PATH
1024
1026
HUMAN INTERFACE DEVICE
1030

APPARATUS, SYSTEM AND METHOD FOR AN ELECTRONIC POKER GAME VARIATION

CROSS REFERENCE TO RELATED APPLICATIONS

This Application claims the benefit of U.S. Provisional Application No. 61/346,810 to Rinaldis, filed May 20, 2010 and entitled, "APPARATUS AND METHOD FOR AN ELECTRONIC POKER GAME VARIATION," which is hereby incorporated by reference in its entirety.

BACKGROUND OF THE INVENTION

1. Field of the Invention

Embodiments of the invention described herein pertain to the field of computer systems. More particularly, but not by way of limitation, one or more embodiments of the invention enable an apparatus, system and method for an electronic poker game variation.

2. Description of the Related Art

The origins of American poker have been traced back to the early nineteenth century in the New Orleans and Mississippi regions. Although earlier influences on the game of poker are a subject of some debate, poker closely resembles the seventeenth century Persian game of As Nas. Today there are many varieties of the game of poker, such as five card draw, seven card stud and Texas hold 'em. Since the origination of the standard game, many variations on the game of poker have been patented.

The standard game of five card draw poker is generally played as illustrated in FIG. 1. First, a player places a wager, purchases entry into the game or antes at step 101. The wager may be used to create a jackpot split between the winner or winners and the house. At step 103 the player randomly receives five initial playing cards from a standard fifty-two card deck. The cards a player receives are often termed his "hand." A typical card is illustrated in FIG. 2. Each playing card contains suit 201, which may be hearts, diamonds, spades or clubs, and symbol 203. In FIG. 2, for example, suit 201 of playing card 200 is the suit of clubs. Symbol 203 may be a number or a letter. In the standard game, the potential numbers which may be assigned to symbol 203 range from two to ten, inclusive. The potential letters which may be assigned to symbol 203 are J, Q, K or A which represent a jack, queen, king and ace respectively. In FIG. 2, for example, symbol 203 on playing card 200 is the number "2." Each combination of suit 201 and symbol 203 can only occur once in a fifty-two card deck of cards. Therefore, a standard deck will contain thirteen cards containing a suit of hearts: the cards with the numbers two through ten of hearts, in addition to a jack, queen, king, and ace of hearts. The same is true for the remaining three suits of diamonds, spades and clubs. In a fifty-two card game, there are 2,598,960 different initial five-card hands possible.

At step 105, the player reviews his cards and determines which cards he or she would like to keep and how many cards he or she would like to discard. In step 107, the unselected cards are discarded and the player then receives new cards to replace any cards that have been discarded. For example, a player may choose to keep three of his or her five initial cards. The remaining two cards are discarded and the player receives two new cards in their place, such that five cards remain in the player's hand. Traditionally, in a multi-player game, a player may have the opportunity to increase his or her bet after steps 103 and 107.

At step 109, the cards in the player's hand are checked to see if the hand is a winner. To determine if a hand is a winner the hand is checked to see if it matches any of a predetermined set of winning hands. For example, a hand containing three cards having the same symbol 203, e.g., a "2," such as the two of diamonds, two of clubs and two of spades, may be a winning hand. The various winning hands in the set of winning hands may have different payout amounts or payout percentages, and different variations of the game may have different winning hands.

Traditionally, in a multi-player game, the player with the highest value winning hand wins at step 111 and may receive the jackpot, thereby ending the game at step 113. Alternatively, in some standard electronic poker games, a player holding any one of several predetermined winning hands may be a winner at step 111 and receive the corresponding payout. If no one wins, at step 111, the game ends at step 113 and the jackpot rolls over (or accrues to the house) and a new game may begin.

There is a continuing commercial need for new and exciting electronic poker games that provide second chance games that will encourage players to continue to patronize poker providers. For at least the limitations described above there is a need for an apparatus, system and method for new forms of second chance electronic poker games.

BRIEF SUMMARY OF THE INVENTION

One or more embodiments of the invention enable an apparatus, system and method for an electronic poker game variation.

An apparatus, system and method for an electronic poker game variation is described, the apparatus, system and method comprising generating an electronic poker hand for an electronic poker game, the hand comprising a predetermined set of available cards. The user may or may not be charged to play the game. In some embodiments, the cards in the electronic poker hand are randomly generated using a random or pseudo-random number generator known to those of skill in the art. In some embodiments, the game is a multi-player game, and in other embodiments the player may play against the house. In the primary game, the player may have the option of selecting none, some or all of the cards in the electronic poker hand to be replaced. The primary game ends when the system checks to see if the electronic poker hand is a winning hand and awards the player any corresponding credits. Whether or not the electronic poker hand is a winning hand, play proceeds when the system compares the electronic poker hand to a set of qualifying hands to determine if the electronic poker hand is a qualifying hand. A qualifying hand is any hand that entitles a player to an extra card and may comprise a hand that is one card short of a winning hand. At the conclusion of the primary game, the system may offer a second chance to win to players with a qualifying hand, the second chance comprising generating an extra card, creating a second electronic poker hand selected from the first electronic poker hand and the extra card and checking the winning hands against the second electronic poker hand for a match to identify a second chance winner. The cost of the extra card may equal the expected value of the extra card. The second electronic poker hand may be selected by choosing the hand with the highest possible value.

In further embodiments, features from specific embodiments may be combined with features from other embodiments. For example, features from one embodiment may be combined with features from any of the other embodiments.

In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
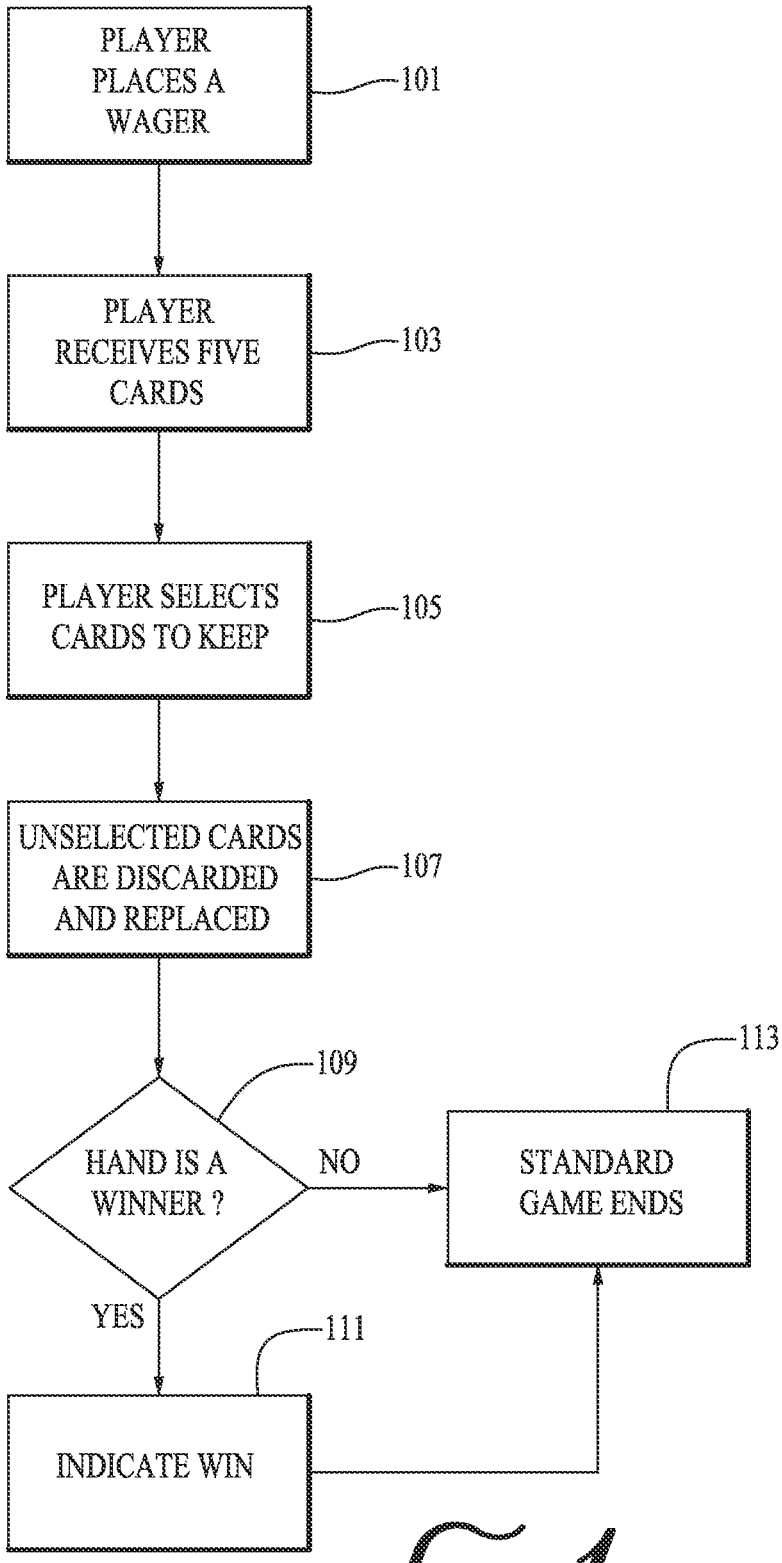
FIG. 1 PRIOR ART
FIG. 1 is a flowchart illustrating the method of playing one or more variations of the standard game of poker of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for an electronic poker variation will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

One or more embodiments of the invention provide new variations of an electronic poker game. The game of the invention may be played on a plurality of computer apparatuses such as, for example, a video poker machine, a casino slot-machine-style device, a personal computer (through an installed application or a web browser) such as a desktop, laptop, a netbook computer, palm computer, PDA or other personal computing device, a gaming console computer, a handheld computing device, a cellular telephone or any computing system capable of performing the instructions required to play the game, such as a system illustrated in FIG. 8 and described below. Computer apparatuses capable of performing the game may provide a display to show the player one or more electronic poker cards and provide controls (physical controls, such as buttons or keys, or virtual or programmed controls, such as buttons on a touch screen) for the various input and output functions needed to play the game. While the invention is described in terms of a casino-style embodiment, nothing herein is intended to limit the invention to that embodiment.

The electronic poker game of the invention may be played as a single or multi-player game. In a multi-player game, a group of players may contribute to and share in a jackpot pool. In some multi-player embodiments, all players at a given location may participate in the jackpot pool or a progressive jackpot. In other embodiments, players may participate in a jackpot pool or a progressive jackpot that may be won by players connected by a network, over the Internet, or other form of communication link as understood by those of skill in the art. For example, a 93% return to the winner(s) may be used, where for example when the house collects $1000.00, on average $930.00 goes to the winner(s). In still other embodiments, a player may play alone against the house, such as in an embodiment installed on a personal computer or an embodiment at a casino. In such an instance, a player's winnings may depend upon the amount bet by the player. While the invention is described in terms of a single-player game for clarity of description and to better illustrate the novelty of the invention, the invention applies equally to multiplayer embodiments.

Figure 3:
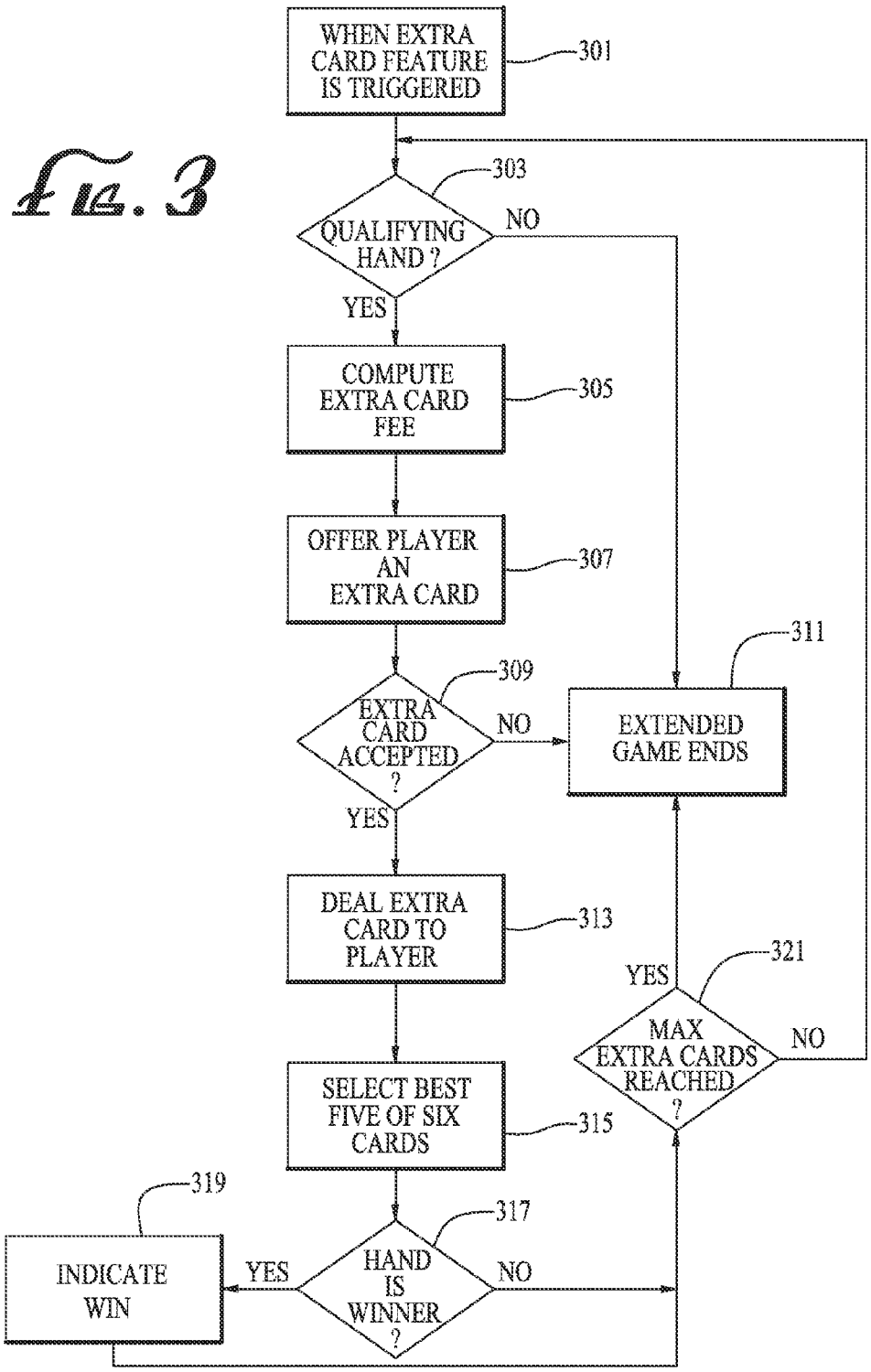
FIG. 3 is a flow chart illustrating an exemplary process or method for a second chance option in one or more embodiments of the invention.

FIG. 3 illustrates one method of the game of the invention. A detailed description of FIG. 3 may be found below.

Figure 2:
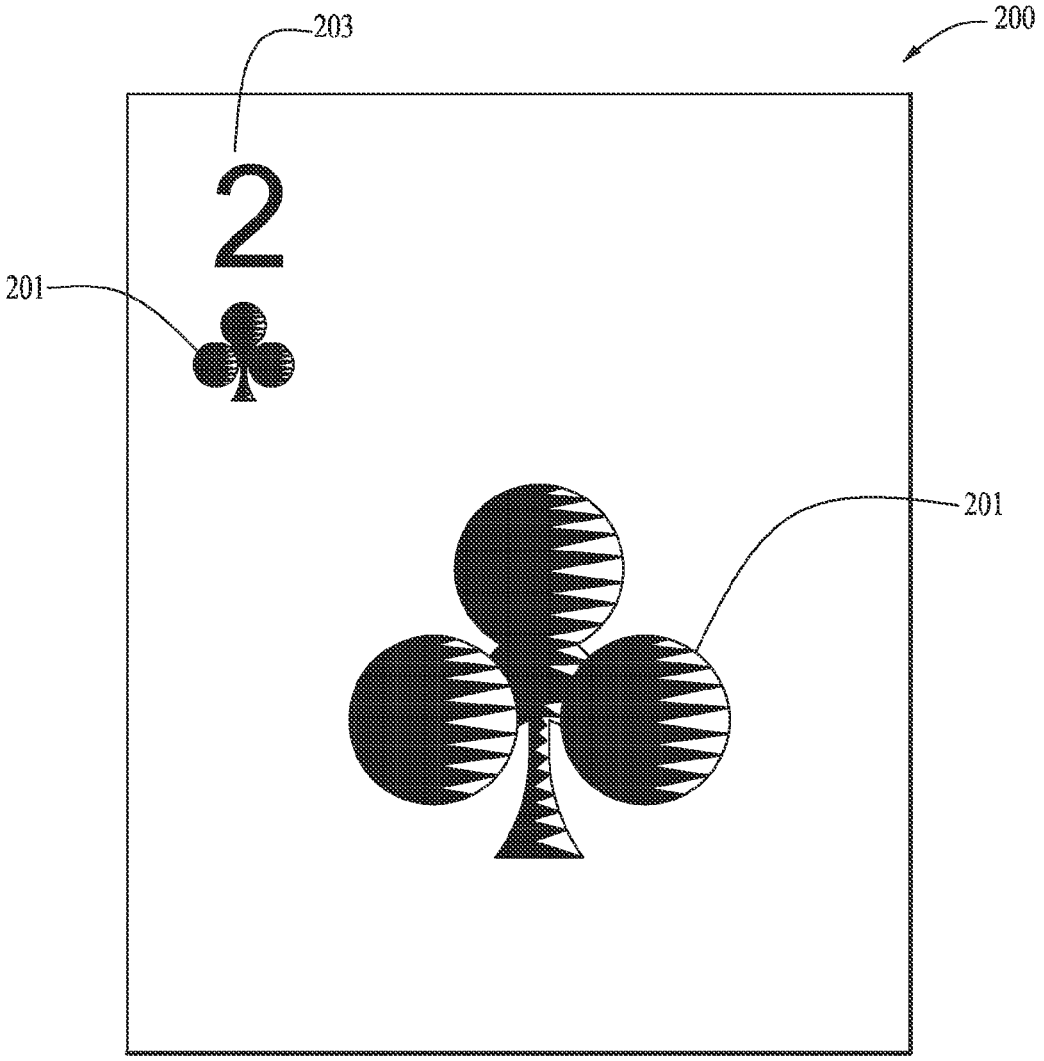
FIG. 2 PRIOR ART
FIG. 2 illustrates an exemplary poker card for a standard poker game of the prior art.

The electronic poker hand of the invention may comprise any number or form of playing cards displayed by a computer to a player/user. Any format of card is contemplated by the invention, from the traditional numbered and suited cards of a fifty-two card deck, such as the card in FIG. 2, to more modern electronic poker cards using letters, symbols or pictures in decks of varying size, for example a stripped deck may be used. In addition, any sized hand may be used, such as a five card hand, a seven card hand or a two card hand. Thus, the invention is not limited to any particularly type of card, number of decks or hand size. In one or more embodiments, more than one deck of cards may be used. So as to clearly explain the invention, this description focuses on a five card poker hand using cards from one standard fifty-two card deck.

Figure 4:
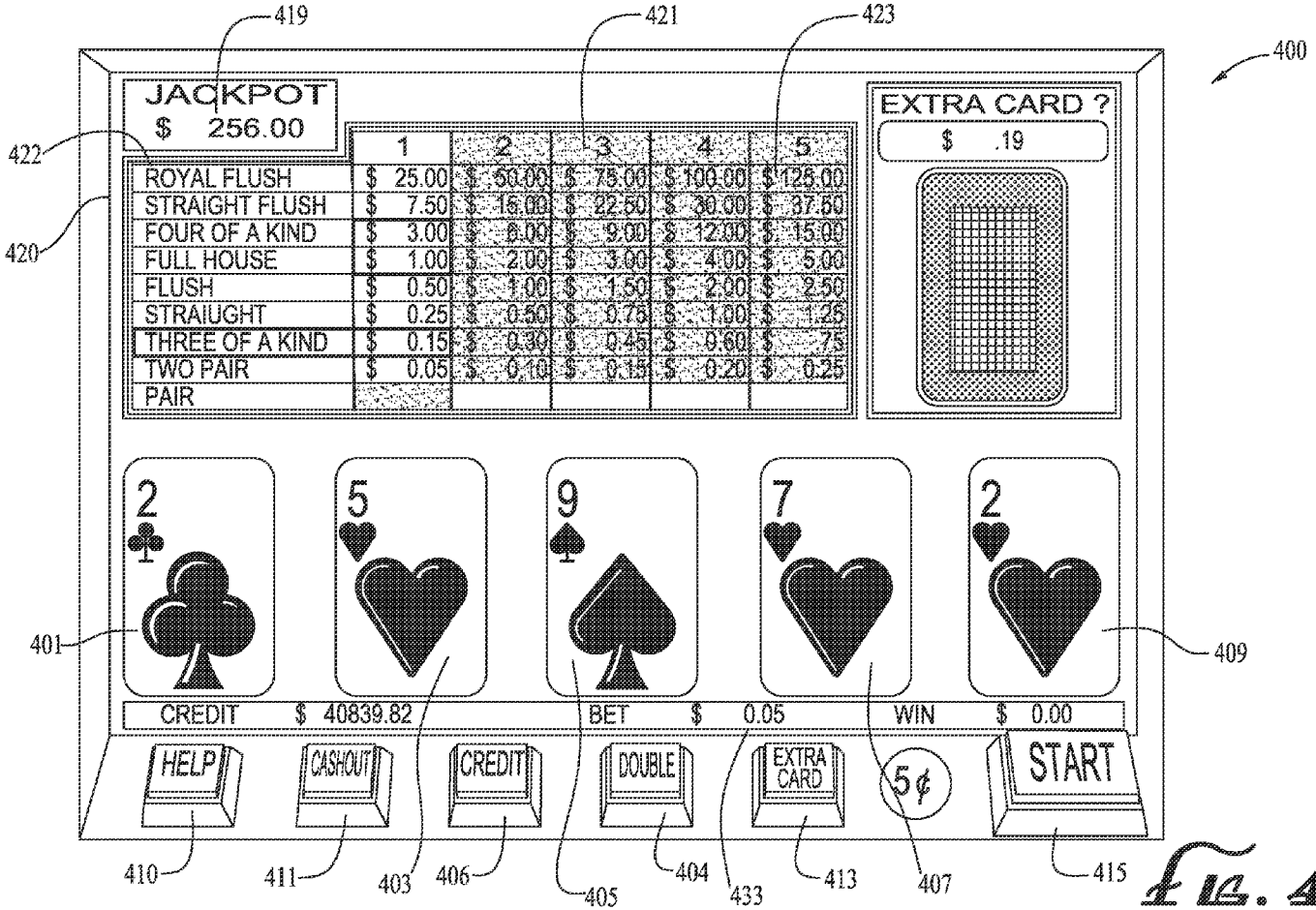
FIG. 4 illustrates an electronic poker game apparatus and display that may be used in one or more embodiments of the invention.

The electronic poker hand of FIG. 4 comprises five cards, 401-409, selected from a deck. In some embodiments, the cards may be selected randomly, using a random or pseudo-random generation algorithm well known to those of skill in the art. In other embodiments, the cards may be predetermined or selected from a list. While the available cards typically comprise four suits, namely, hearts, diamonds, clubs and spades, where each suit has one card each of the numbers 2 to 10, inclusive, and letters J, Q, K and A, as in the standard game described above, the invention is not so limited and will perform equally as well with cards comprising symbols, icons, words, pictographs, cartoons, photographs or other representations that may be combined to form winning hands. For example, the five card poker hand shown in FIG. 4 comprises two of clubs 401, five of hearts 403, nine of spades 405, seven of hearts 407 and two of hearts 409. So as not to obscure the novelty of the invention, the method of the invention is described in terms of the standard fifty two card deck, but it is not so limited. Exemplary electronic poker apparatus 400 may display the amount bet on the hand of FIG. 4, as shown in bet display 433, the amount won, the number of credits a player has and/or may display the size of progressive jackpot 419. Various controls (whether physical or programmed) may also be present on or near exemplary electronic poker display 420, such as start button 415, cashout button 411, hold buttons (not shown), help button 410, extra card button 413, credit button 406 and/or double button 404.

In one or more embodiments, a player may commence a game by inserting credits or a credit card or logging into a computer apparatus or by using any other mechanism known for this purpose by those of ordinary skill in the art. A player may enter identifying information and/or credits using an input device such as a keyboard, coin slot, touch screen or card reader. Referring to the exemplary apparatus of FIG. 4, once credits have been added the player begins the game by pressing start button 415 at which point the hand shown in FIG. 4 is displayed on exemplary electronic poker display 420 of apparatus 400. The player may then review the cards drawn and select which cards will be kept in the hand. For example, a player may wish to keep two of clubs 401 and two of hearts 409 in the hand, but discard five of hearts 403, nine of spades 405 and seven of hearts 407. The game may or may not have restrictions regarding how many and which cards may be discarded by a player and replaced. For example, some embodiments of the game may leave a player free to discard and replace none, some or all of the cards in an initial hand. In other embodiments, a player may be permitted to discard a maximum of four of the five cards in an initial hand where four cards may only be discarded if the remaining card is an ace.

A player may indicate the cards to keep or "hold" in the hand by touching the selected cards on the electronic poker screen using a touch screen, by pressing a hold button located underneath each card, by clicking the cards using a mouse, by speaking the names of the cards into a microphone or by using any other method of selecting cards as understood by those of skill in the art. Exemplary electronic poker display 420 may indicate which cards have been held by highlighting the selected cards (not shown), marking them as "held" or otherwise indicating on the screen the player's choice. A player may finalize his or her selection of cards, for example, by pressing start button 415 or interacting with any other interface element implemented for that purpose.

Figure 5:
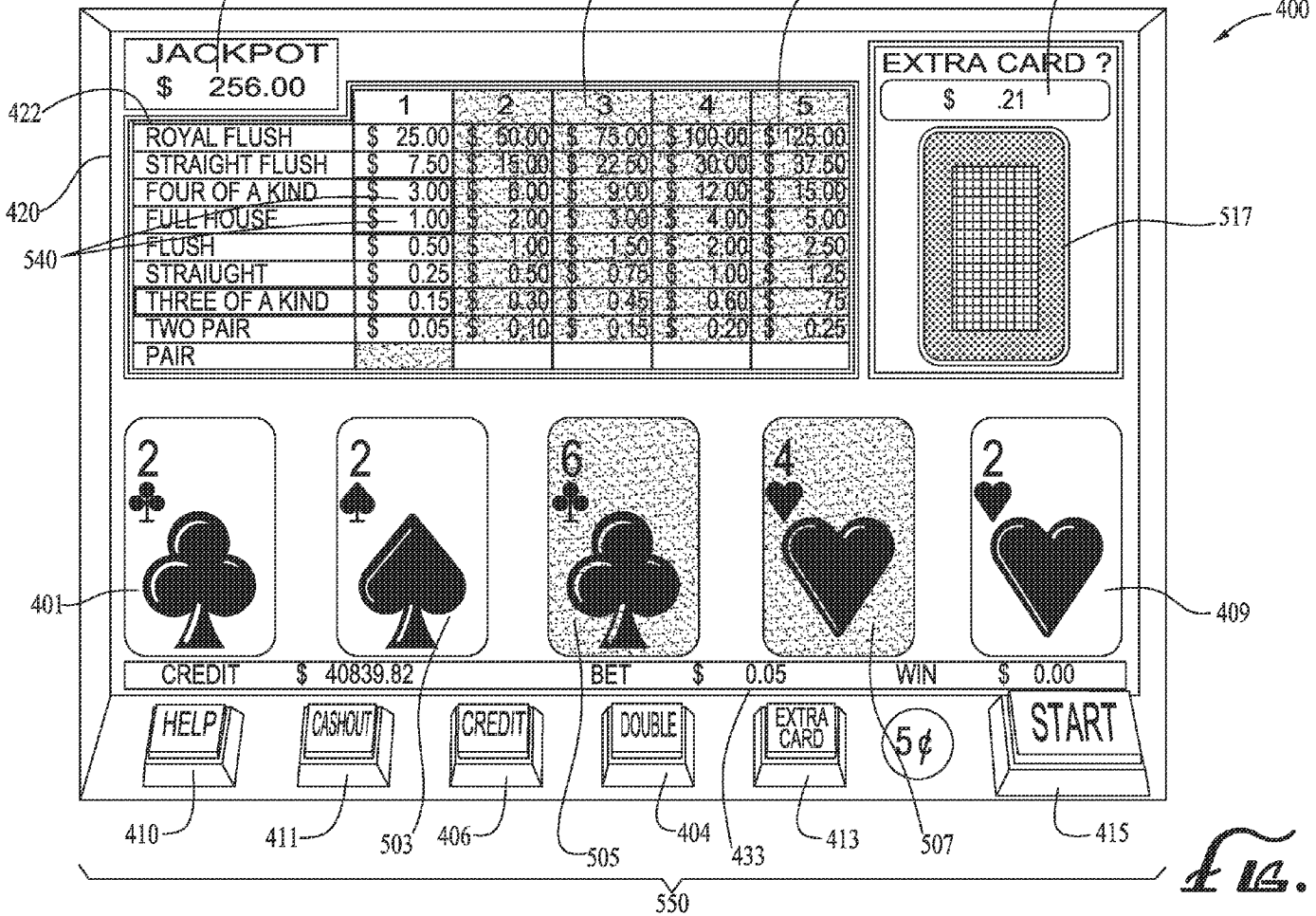
FIG. 5 illustrates an electronic poker game apparatus and display of a qualifying hand that may be used to implement one or more embodiments of the invention.
Figure 6A:
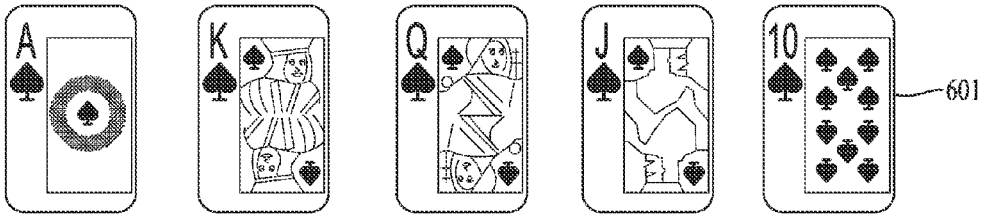
FIG. 6A-6F illustrates a predetermined set of winning hands in one or more embodiments of the invention.
Figure 6B:
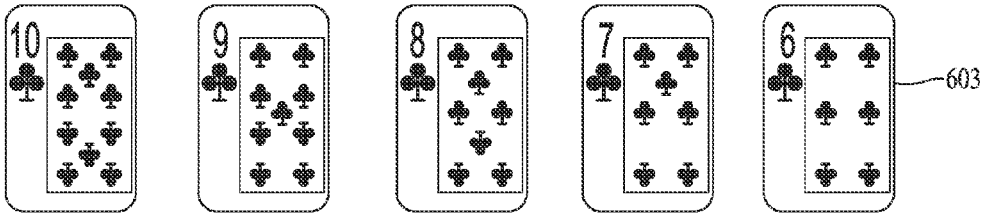
Figure 6C:
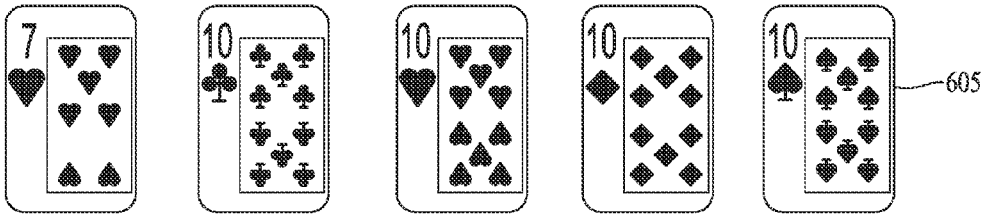
Figure 6D:
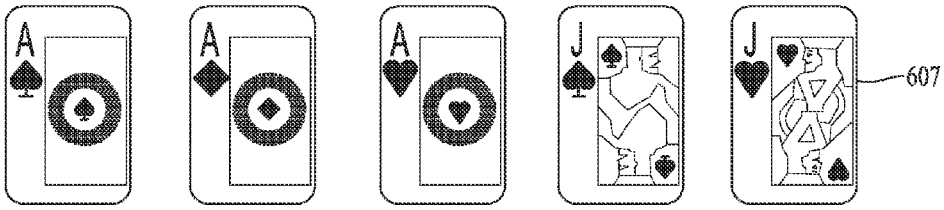
Figure 6E:
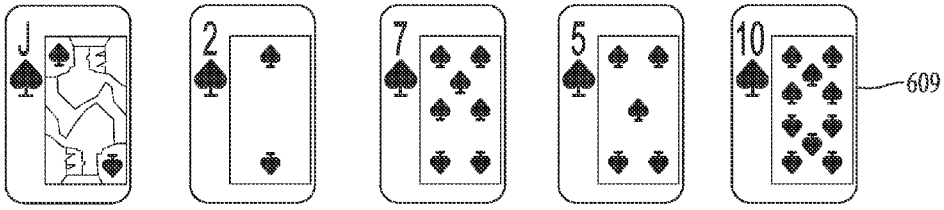
Figure 6F:
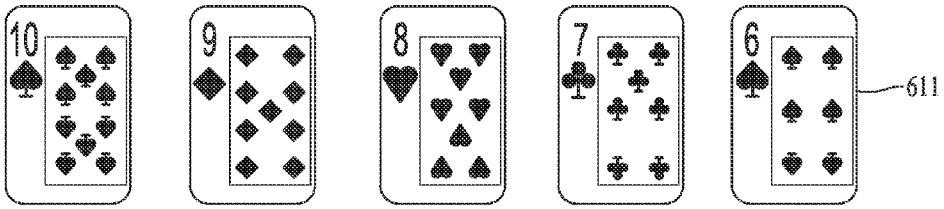

In the primary game, the cards that have not been selected are then replaced with new cards that have not previously been drawn from the deck(s). For example in FIG. 4, five of hearts 403, nine of spades 405 and seven of hearts 407 have not been selected as cards to keep and will therefore be replaced. New cards may be drawn to replace the discarded cards by using a pseudo-random generation or random generation procedure. In certain embodiments, the cards may be selected from a list or predetermined based upon a non-random generation algorithm. As shown in FIG. 5, the three discarded cards of the example hand have been replaced with two of spades 503, six of clubs 505 and four of hearts 507. The held cards, two of clubs 401 and two of hearts 409 are also included in primary hand 550.

Figure 7A:
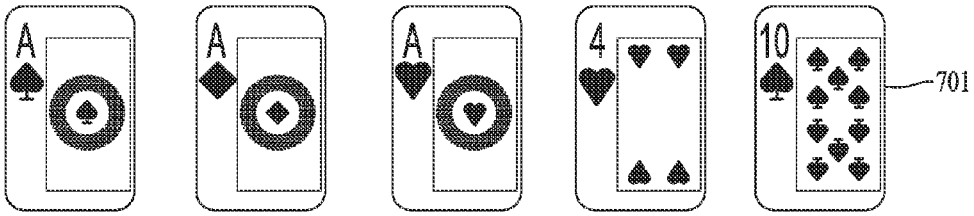
FIG. 7A-7D illustrates an additional predetermined set of winning hands in one or more embodiments of the invention.
Figure 7B:
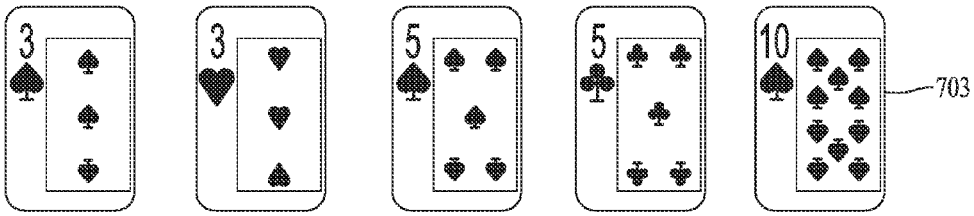
Figure 7C:
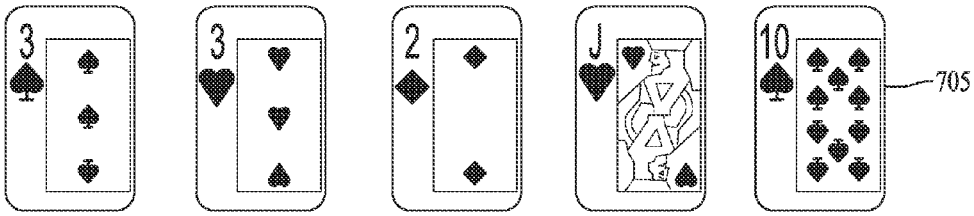
Figure 7D:
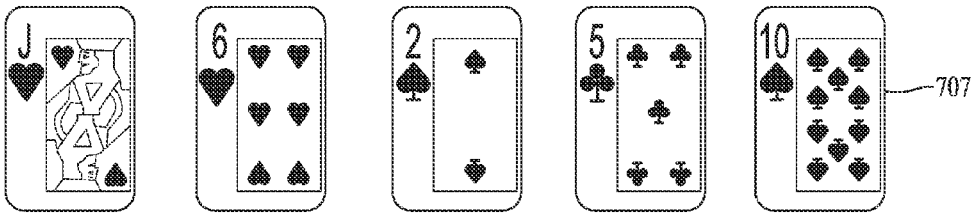

Various modern poker games comprise a number of winning hands. Different hands have a different statistical likelihood of occurring and the payout for matching a given winning hand reflects that likelihood. FIGS. 6A to 6F and FIGS. 7A to 7D illustrate various winning hands provided by one or more embodiments of the invention and show one potential card combination meeting the necessary criteria for that winning hand. For example, two pair 703 may be made by any two pairs of cards, and by way of example, FIG. 7B shows two pair 703 as a hand having two threes and two fives, but any other hand having two pairs of cards will also match this winning hand. A single embodiment may not support all of the winning hands illustrated but will still be within the scope of the invention. In this example, pair 705 and jacks or better 707 do not qualify for a prize. Other embodiments, including those with other electronic poker card formats, may use other hands as winning hands. FIGS. 6A to 6F and FIGS. 7A to 7D are provided for illustration only.

| FIG. | Hand Reference | Winning Hands | Example Payout per coin bet (for a $0.05 coin) |
|---|---|---|---|
| 6A | 601 | Royal Flush | $25.00 |
| 6B | 603 | Straight Flush | $ 7.50 |
| 6C | 605 | Four of a Kind | $ 3.00 |
| 6D | 607 | Full House | $ 1.00 |
| 6E | 609 | Flush | $ 0.50 |
| 6F | 611 | Straight | $ 0.25 |
| 7A | 701 | Three of a Kind | $ 0.15 |
| 7B | 703 | Two Pair | $.05 |
| 7C | 705 | Pair | $ 0.00 |
| 7D | 707 | Jacks or Better | $ 0.00 |

Play in the game of the invention may proceed in any number of variations of the game, such as that described by FIG. 3 and elsewhere herein, for example. In FIG. 5, the player has bet $0.05, as shown in bet window 433, initially selected two cards to keep (two of clubs 401 and two of hearts 409) and received three new cards (two of spades 503, six of clubs 505 and four of hearts 507) to make up primary hand 550. Primary hand 550 is then compared to the winning hands, for example the hands described above. Where more than one winning hand is matched, the player may be awarded the highest prize or the player may be awarded multiple prizes. In FIG. 5, primary hand 550 matches the three of a kind 701 and pair 705 winning hands. In this example, the highest prize is the three of a kind 701, made up of two of clubs 401, two of spades 503 and two of hearts 409. In FIG. 5, six of clubs 505 and four of hearts 507 are shown shaded as they are not part of the winning card combination.

Exemplary electronic poker screen 400 may display the potential winning hands and the payouts for each winning hand. For example, the names of the winning hands may be displayed in column 422 and the different number of credits possibly bet may be displayed in row 421. Thus, in the example shown, a royal flush hand in a game where a player bets 5 credits ($0.05 per credit), wins $125.00, as shown in prize square 423. The system may indicate a winning hand to a player, for example by highlighting the appropriate box in column 422 on exemplary electronic poker display 420.

In the system and method of the invention, as illustrated in FIG. 3, at the conclusion of the primary game, the extra card feature of the invention may be triggered at step 301 whether or not the player's hand contains a winning hand. At step 303, the system evaluates primary hand 550 to see if it is a "qualifying hand." In one or more embodiments, a qualifying hand may be a hand that is within one card of matching a winning hand, where the winning hand has a payout greater than any payout the player has already earned during the primary game. In some embodiments, the set of qualifying hands may be derived from less than the set of all the winning hands. In other embodiments, a qualifying hand may be hand that is more than one card away from a winning hand, or may be a hand that contains an ace or any other designated card.

As shown in FIG. 5, primary hand 550 matches winning hand 701 ("three of a kind"), which pays $0.15 for a $0.05 bet in the example embodiment. In FIG. 5, six of clubs 505 and four of hearts 507 are shown shaded since they are not part of the three of a kind card combination. The evaluation at step 303 determines that primary hand 550 is also a qualifying hand, in that it is one card short of matching the following winning hands:

| FIG | Hand Reference | Winning Hands | Example Payout ($0.05 bet) | Missing Card |
|---|---|---|---|---|
| 6C | 605 | Four of a Kind | $3.00 | Two of Diamonds |
| 6D | 607 | Full House | $1.00 | Any one of: Six of Hearts, Six of Diamonds, Six of Spades, Four of Diamonds, Four of Clubs or Four of Spades |

As winning hands four of a kind 605 and full house 607 win a higher payout than winning hand 701 (three of a kind), those payout amounts may be indicated to the player on exemplary electronic poker display 420, as exemplified by payout squares 540, which are shown highlighted. Returning to FIG. 3, if a player's hand is not a qualifying hand, then the extended game may end at step 311. In the example of primary hand 550, it is a qualifying hand so the system may compute the extra card fee at step 305.

The cost of an extra card may be calculated using a variety of methods. In certain embodiments, the cost of an extra card may be a fixed predetermined value or may vary based upon the amount bet by the player. In some embodiments, the cost of an extra card may depend on the probability that the extra card will complete a new winning hand and the amount of the payout that can be won for that hand, i.e., the expected value of the extra card. If a hand is one card away from more than one winning hand, then the cost of the extra card may be cumulative. For example, primary hand 550 is one card away from four of a kind 605 and full house 607. In that instance, the cost of an extra card may be calculated as follows:

(1) Calculate the expected value of completing a four of a kind 605 pattern with the extra card. This is equal to the four of a kind prize value times the number of cards left in the deck that can complete the four of a kind pattern, divided by the total number of cards left in the deck. In the example, five cents has been bet, so the four of a kind prize value is $3.00. Only one card left in the deck can complete a four of a kind hand. Since primary hand 550 already contains two of clubs 401, two of spades 503 and two of hearts 409, the only card that can be drawn to complete four of a kind 605 pattern is the two of diamonds. The player initially drew five cards and then replaced three, so of the fifty-two cards in the deck of this example, eight have been drawn and forty-four remain in the deck. Thus, the expected value of obtaining four of a kind 605 is equal to (3.00)*(1.00)/44.00=$0.068.

(2) Calculate the expected value of completing a full house 607 pattern with the extra card. This is equal to the full house prize value times the total number of cards left in the deck that can complete the full house pattern, divided by the number of cards left in the deck. In the example, five cents has been bet, so the full house prize value is $1.00. There are six possible cards left in the deck that can complete the full house hand: the six of hearts, six of diamonds, six of spades, four of diamonds, four of clubs or four of spades. The player initially drew five cards and then replaced three, so of the fifty-two cards in the deck of this example, eight have been drawn and forty-four remain in the deck. Thus, the expected value of obtaining full house 607 is equal to (1.00)*(6.00)/44.00=$0.136.

(3) Add the expected values of all possible winning hands. In the example, this is the expected value of obtaining four of a kind 605 winning hand plus the expected value of obtaining full house 607 winning hand, which is equal to $0.068 plus $0.136, or $0.204.

(4) Round to determine the final extra card fee. The extra card cost may be rounded to determine the final cost. For example, $0.204 may be rounded up to twenty-one cents, or it may be rounded down to twenty cents. In some embodiments, the rounding may take place during each individual expected value calculation. In other embodiments, the cost may be rounded only after all the expected values have been added together. In yet other embodiments, only one or two decimal places may be retained during calculations and no rounding may be necessary.

Other methods of calculating the cost of an extra card are also contemplated and within the scope of the invention. For example, the cost of an extra card may be greater than or less than the expected value of obtaining a new winning hand.

The player may be offered a second chance to win with an extra card at step 307 and the system may inquire whether the player would like to accept the extra card at step 309. The cost of the extra card may be displayed to the player in extra card cost window 525. If the player chooses the extra card option, the system collects the second chance fee for the extra card and deals an extra card to the player at step 313. A second chance to win may be offered on multiple hands where the player is playing in a multi-hand embodiment. In some embodiments, a player may accept an extra card by touching extra card button 413 or otherwise indicating his or her intention to purchase an extra card in one or more pending hands. Alternatively, a player may decline an extra card by touching start button 415 or cashout button 411 and the extended game ends at step 311.

At step 313, the system generates an extra card by revealing the suit and symbol of extra card 517. In one or more embodiments, the system randomly or pseudo-randomly selects extra card 517 from those cards remaining in the deck using techniques known to those of skill in the programming arts. In other embodiments, the system may select extra card 517 from a list or extra card 517 may be predetermined from the earlier draw.

At step 315, the system selects the highest value five-card hand from among the six cards in primary hand 550 and extra card 517. In this example, if extra card 517 is the six of diamonds, then the system will select the final hand to contain extra card 517 (six of diamonds), two of clubs 401, two of spades 503, six of clubs 505 and two of hearts 409 so that the final hand matches full house 607 winning hand. Final hands having different numbers of cards, such as two cards or six cards, are also within the scope of the invention. In certain embodiments, the player may select the cards contained in the final hand. In yet other embodiments, a player may select a card in primary hand 550 to be replaced by extra card 517 prior to knowing the suit and symbol of extra card 517. Once a final hand is chosen, the system then asks whether the final hand is a winner at step 317 and the win may then be indicated to the player at step 319.

Whether the final hand wins or not, in one or more embodiments the system may offer the player another chance to play. If selected, the system may generate another extra card, up to the maximum number of extra cards allowed, as indicated by step 321. In this example, the system may then return to step 303 to reevaluate the player's hand, which still contains the possibility of obtaining winning hand four of a kind 605. Winning hand four of a kind 605 has a higher payout than that of full house 607, so play may continue at step 303 as described above. In some embodiments, an additional winning hand may have an equal or lower payout than that already won, if any, to qualify the player for an extra card. In other embodiments, only one extra card may be allowed per game. In certain embodiments, only primary hand 550 is eligible to win progressive jackpot 419. In other embodiments, the final hand may be eligible to win progressive jackpot 419.

Computer System Architecture

The method described herein is not limited as to the type of computer it may run upon and may for instance operate on any generalized computer system that has the computational ability to execute the methods described herein and can display the results of the user's/player's choices on a display means. The computer typically includes at least a keyboard, a display device such as a monitor, and a pointing device such as a mouse. The computer also typically comprises a random access memory, a read only memory, a central processing unit and a storage device such as a hard disk drive. In some embodiments of the interface, the computer may also comprise a network connection that allows the computer to send and receive data through a computer network such as the Internet. Casino-style electronic gaming machines, bingo hall electronic gaming machines, mobile computer platforms such as cellular telephones, smart phone, Personal Desktop Assistants (PDAs), kiosks, set top boxes, games boxes or any other computational device, portable, personal or otherwise, may also qualify as a computer system capable of executing the methods described herein.

In various embodiments, the present invention may be implemented as a method, apparatus, system or article of manufacture using standard "programming and/or engineering techniques to produce software, firmware, hardware, or any combination thereof. The term "article of manufacture" (or alternatively, "computer program product") as used herein is intended to encompass a computer program accessible from any computer-readable device, carrier or media. In addition, the software in which various embodiments are implemented may be accessible through the transmission medium, for example, from a server over the network. The article of manufacture in which the code is implemented also encompasses transmission media, such as the network transmission line and wireless transmission media. Thus, the article of manufacture also comprises the medium in which the code is embedded. Those skilled in the art will recognize that many modifications may be made to this configuration without departing from the scope of the present invention.

Embodiments of the system may display one or more electronic poker cards, the display of which is embodied in software that may execute on one or more computers having a computer usable memory medium (or a computer readable memory medium) and computer readable program code. The computer readable program code may include an input function, display function, computation functions, card reader function and other functions typical of a gaming computer as understood by those of skill in the art. The various software functions are configured to perform the functions of an electronic poker game variation.

Furthermore, embodiments of the present invention may be implemented as a program of computer-readable instructions and/or computer-readable data stored on a computer-readable medium. Programs, data and other information may constitute, but are not limited to, sets of computer instructions, code sequences, configuration information, and other information in any form, format or language usable by a general purpose computer or other processing device, such that when such a computer contains, is programmed with, or has access to said programs, data and other information said general purpose computer is transformed into a machine capable of performing an electronic poker game variation, such as those described above. A computer-readable medium suitable to provide computer readable instructions and/or computer readable data for the methods and processes described herein may be any type of magnetic, optical, or electrical storage medium including a disk, tape, CD, DVD, flash drive, thumb drive, storage card, or any other memory device or other storage medium known to those of skill in the art.

In one or more embodiments of the invention, the methods described here may not be limited as to the type of computer it may run upon and may for instance operate on any generalized computer system that has the computational ability to execute the methods described herein and can display the results of the user's choices on one or more display devices. Display devices appropriate for providing interaction with the invention described herein includes, but is not limited to, computer monitors, cell phones, PDAs, televisions, or any other form of computer controllable output display. As used herein, a computer system refers to but is not limited to any type of computing device, including its associated computer software, data, peripheral devices, communications equipment and any required or desired computers that may achieve direct or indirect communication with a primary computing device.

In one or more embodiments of the invention, a general-purpose computer may be utilized to implement one or more aspects of the invention. In one or more embodiments of the invention, the computer may include various input and output means, including but not limited to a keyboard or other textual input devices, a display device such as a monitor or other display screen, and a pointing device and/or user selection indicator such as a mouse, keypad, touch screen, pointing device, or other known input/output devices known to those of skill in the art. The general-purpose computer described herein may include one or more banks of random access memory, read only memory, and one or more central processing unit(s). The general-purpose computer described herein may also include one or more data storage device(s) such as a hard disk drive, or other computer readable medium discussed above. An operating system that executes within the computer memory may provide an interface between the hardware and software. The operating system may be responsible for managing, coordinating and sharing of the limited resources within the computer. Software programs that run on the computer may be performed by an operating system to provide an electronic poker game variation of the invention with access to the resources needed to execute. In other embodiments the electronic poker game may run stand-alone on the processor to perform the methods described herein.

In one or more embodiments of the invention, the method (s) described herein, when loaded on or executing through or by one or more general purpose computer(s) described above, may transform the general-purpose computer(s) into a specially programmed computer able to perform the method or methods described herein. In one or more embodiments of the invention, the computer-readable storage medium(s) encoded with computer program instructions that, when accessed by a computer, may cause the computer to load the electronic poker game instructions to a memory there accessible, thereby creates a specially programmed computer able to perform the methods described herein as a specially programmed computer.

The specially programmed computer of the invention may also comprise a connection that allows the computer to send and/or receive data through a computer network such as the Internet or other communication network. Mobile computer platforms such as cellular telephones, Personal Desktop Assistants (PDAs), other hand-held computing devices, digital recorders, wearable computing devices, kiosks, set top boxes, games boxes or any other computational device, portable, personal, real or virtual or otherwise, may also qualify as a computer system or part of a computer system capable of executing the methods described herein as a specially programmed computer.

Figure 8:
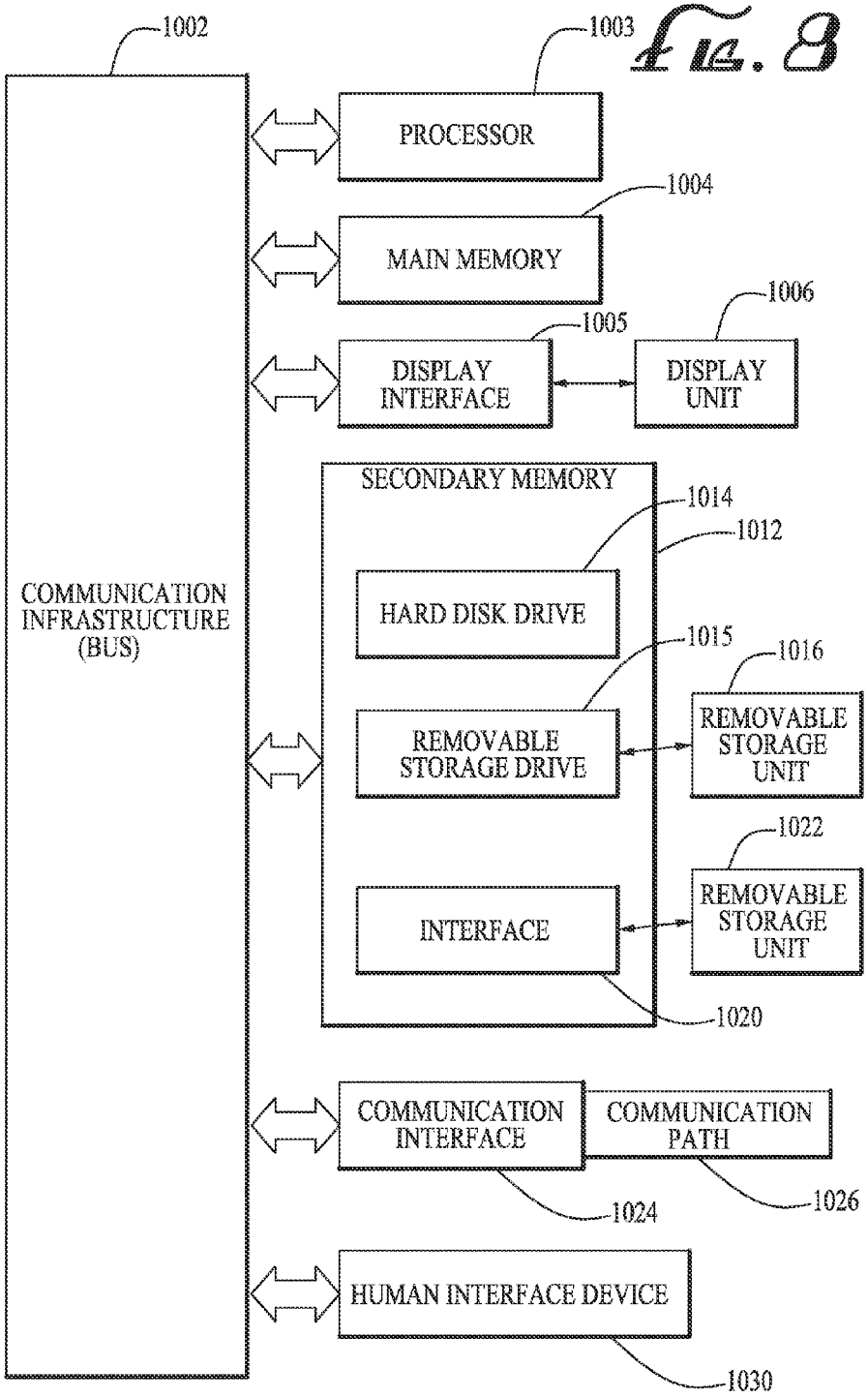
FIG. 8 illustrates a general-purpose computer and peripherals that when programmed as described herein may operate as a programmed computer capable of implementing one or more methods, apparatus and/or systems of the invention.

FIG. 8 depicts a general-purpose computer and peripherals, when programmed as described herein, may operate as a specially programmed computer capable of implementing one or more methods, apparatus and/or systems of the invention. Processor 1003 may be coupled to bi-directional communication infrastructure 1002 such as Communication Infrastructure System Bus 1002. Communication Infrastructure 1002 may generally be a system bus that provides an interface to the other components in the general-purpose computer system such as Processor 1003, Main Memory 1004, Display Interface 1005, Secondary Memory 1012 and/or Communication Interface 1024.

Main memory 1004 may provide a computer readable medium for accessing and executed stored data and applications. Display Interface 1005 may communicate with Display Unit 1006 that may be utilized to display outputs to the user of the specially-programmed computer system. Display Unit 1006 may comprise one or more monitors that may visually depict aspects of the computer program to the user. Main Memory 1004 and Display Interface 1005 may be coupled to Communication Infrastructure 1002, which may serve as the interface point to Secondary Memory 1012 and Communication Interface 1024. Secondary Memory 1012 may provide additional memory resources beyond main Memory 1004, and may generally function as a storage location for computer programs to be executed by Processor 1003. Either fixed or removable computer-readable media may serve as Secondary Memory 1012. Secondary Memory 1012 may comprise, for example, Hard Disk 1014 and Removable Storage Drive 1015 that may have an associated Removable Storage Unit 1016. There may be multiple sources of Secondary Memory 1012 and systems of the invention may be configured as needed to support the data storage requirements of the user and the methods described herein. Secondary Memory 1012 may also comprise Interface 1020 that serves as an interface point to additional storage such as Removable Storage Unit 1022. Numerous types of data storage devices may serve as repositories for data utilized by the specially programmed computer system of the invention. For example, magnetic, optical or magnetic-optical storage systems, or any other available mass storage technology that provides a repository for digital information may be used.

Communication Interface 1024 may be coupled to Communication Infrastructure 1002 and may serve as a conduit for data destined for or received from Communication Path 1026. A Network Interface Card (NIC) is an example of the type of device that once coupled to Communication Infrastructure 1002 may provide a mechanism for transporting data to Communication Path 1026. Computer networks such Local Area Networks (LAN), Wide Area Networks (WAN), Wireless networks, optical networks, distributed networks, the Internet or any combination thereof are some examples of the type of communication paths that may be utilized by the specially program computer system of the invention. Communication Path 1026 may comprise any type of telecommunication network or interconnection fabric that can transport data to and from Communication Interface 1024.

To facilitate user interaction with the programmed computer system of the invention, one or more Human Interface Devices (HID) 1030 may be provided. Some examples of HIDs that enable users to input commands or data to the programmed computer of the invention may comprise a keyboard, mouse, touch screen devices, microphones or other audio interface devices, motion sensors or the like, as well as any other device able to accept any kind of human input and in turn communicate that input to Processor 1003 to trigger one or more responses from the specially programmed computer of the invention are within the scope of the system of the invention.

While FIG. 8 depicts a physical device, the scope of the system of the invention may also encompass a virtual device, virtual machine or simulator embodied in one or more computer programs executing on a computer or computer system and acting or providing a computer system environment compatible with the methods and processes of the invention. Where a virtual machine, process, device or otherwise performs substantially similarly to that of a physical computer system of the invention, such a virtual platform will also fall within the scope of a system of the invention, notwithstanding the description herein of a physical system such as that in FIG. 8.

One or more embodiments of the invention are configured to enable the programmed computer of the invention to take the input data given and transform it into an electronic poker game variation by applying one or more of the methods and/or processes of the invention as described herein. Thus the methods described herein are able to transform button presses, cash card input data, touch screen data, system computations of winning numbers, pattern matches and other data, using the system of the invention to result in an output of the system as an electronic poker game variation, using the programmed computer as described herein. Particularly, the system of the invention may be programmed to provide an electronic poker game variation of the invention as described herein.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A computer program product comprising a non-transitory machine-readable storage medium having computer program code stored thereon which when executed by a computer causes the computer to perform the computer program code, the computer program code conducting an electronic poker game variation comprising:

generating a first electronic poker hand for a primary electronic poker game, wherein the first electronic poker hand comprises at least five cards of a deck of cards;

comparing the first electronic poker hand to a set of qualifying hands to confirm the first electronic poker hand is a qualifying hand of the set of qualifying hands, wherein the set of qualifying hands comprises those hands one card short of at least one possible higher paying hand, the comparison thereby identifying the first electronic poker hand as the qualifying hand of the set of qualifying hands;

offering a second chance to win for the qualifying hand at the conclusion of a primary electronic poker game, the second chance to win comprising:

collecting a second chance fee, wherein the second chance fee is determined by calculating an expected value of each of the at least one possible higher paying hand with an extra card from the deck of cards and adding the expected value of each of the at least one possible higher paying hand;

wherein the expected value of each possible higher paying hand is equal to a prize value of achieving a particular one of the at least one possible higher paying hand times the total number of cards left in the deck of cards that can complete the particular one of the at least one possible higher paying hand, divided by the number of cards left in the deck of cards;

generating the extra card from the deck of cards; and selecting a second electronic poker hand, the selecting comprising the steps of:

revealing the extra card; and the selecting of the second electronic poker hand comprises a combination of all cards in the first electronic poker hand and the revealed extra card, such that the selected second electronic poker hand has a highest possible payout value of any card combination in the second electronic poker hand; and applying winning hands to the second electronic poker hand to identify the second electronic poker hand as a winner, wherein the winning hands comprises either (i) the qualifying hand of the set of qualifying hands or (ii) a highest paying hand selected from the at least one possible higher paying hand.

2. The computer program product of claim 1 wherein the electronic poker game is a single player game.

3. The computer program product of claim 1 wherein a player is offered a plurality of the second chance to win opportunities.

4. The computer program product of claim 1 wherein the higher paying hand comprises: royal flush, straight flush, four of a kind, full house, flushes, straight, three of a kind, two pair or a combination thereof.

5. The computer program product of claim 1 wherein the first electronic poker hand comprises five cards.

6. An improved method for playing a poker game variation on a computer, the method transforming the computer into an electronic poker gaming machine, the method performed by a computer, wherein the computer further comprises a non-transitory storage device, the method comprising:

generating a first electronic poker hand for a primary electronic poker game, wherein the first electronic poker hand comprises at least five cards of a deck of cards;

comparing the first electronic poker hand to a set of qualifying hands to confirm the first electronic poker hand is a qualifying hand of the set of qualifying hands, wherein the set of qualifying hands comprises those hands one card short of at least one possible higher paying hand, the comparison thereby identifying the first electronic poker hand as the qualifying hand of the set of qualifying hands;

offering a second chance to win for the qualifying hand at the conclusion of the primary electronic poker game, the second chance to win comprising:

collecting a second chance fee, wherein the second chance fee is determined by calculating an expected value of each of the at least one possible higher paying hand with an extra card from the deck of cards and adding the expected value of each of the at least one possible higher paying hand;

wherein the expected value of each possible higher paying hand is equal to a prize value of achieving a particular one of the at least one possible higher paying hand times the total number of cards left in the deck of cards that can complete the particular one of each of the at least one possible higher paying hands, divided by the number of cards left in the deck of cards;

generating the extra card from the deck of cards; and selecting a second electronic poker hand, the selecting comprising the steps of:

revealing the extra card;

creating the second electronic poker hand from a combination of all cards in the first electronic poker hand and the revealed extra card; and selecting a payout value of the second electronic poker hand, wherein the payout value is selected to have a highest payout value of any card combination in the second electronic poker hand; and applying winning hands to the second electronic poker hand to identify the second electronic poker hand as a winner, wherein the winning hands comprises either (i) the qualifying hand of the set of qualifying hands or (ii) a highest paying hand selected from the at least one possible higher paying hand.

7. An improved method for playing a poker game variation on a computer, the method transforming the computer into an electronic poker gaming machine, the method performed by a computer, wherein the computer further comprises a non-transitory storage device, the method comprising:

generating a first electronic poker hand for a primary electronic poker game, wherein the first electronic poker hand comprises five cards of a deck of cards;

comparing the first electronic poker hand to a set of qualifying hands to confirm the first electronic poker hand is in a qualifying hand of the set of qualifying hands, wherein the set of qualifying hands comprises those hands one card short of at least one possible higher paying hand, the comparison thereby identifying the first electronic poker hand the qualifying hand of the set of qualifying hands;

offering a second chance to win for the qualifying hand at the conclusion of the primary electronic poker game, the second chance to win comprising:

collecting a second chance fee wherein the second chance fee is determined by calculating an expected value of each of the at least one possible higher paying hand with an extra card from the deck of cards and adding the expected value of each of the at least one possible paying hand;

wherein the expected value of each possible higher paying hand is equal to a prize value of achieving a particular one of the at least one possible higher paying hand times the total number of cards left in the deck of cards that can complete each of the possible higher paying hands, divided by the number of cards left in the deck of cards;

generating the extra card from the deck of cards;

generating the extra card from the deck of cards;

revealing the extra card;

creating a second electronic poker hand from a combination of the five cards in the first electronic poker hand and the revealed extra card; and selecting a payout value of the second electronic poker hand, wherein the payout value is selected to have a highest payout value of any five card combination in the second electronic poker hand; and applying winning hands to the second electronic poker hand to identify the second electronic poker hand as a winner, wherein the winning hands comprises either (i) the qualifying hand of the set of qualifying hands or (ii) a highest paying hand selected from the at least one possible higher paying hand.

* * * * *